US005727976A

United States Patent [19]

Nakamoto et al.

[11] Patent Number: 5,727,976

[45] Date of Patent: Mar. 17, 1998

[54] METHOD OF PRODUCING MICRO VACUUM TUBE HAVING COLD EMITTER

[75] Inventors: Masayuki Nakamoto; Tomio Ono, both of Kanagawa-ken, Japan

[73] Assignee: Kabushiki Kaisha Toshiba, Kanagawa-ken, Japan

[21] Appl. No.: 404,277

[22] Filed: Mar. 14, 1995

[30] Foreign Application Priority Data

Mar. 15, 1994 [JP] Japan ..... 6-070153

[51] Int. Cl.[6] ..... H01J 9/02

[52] U.S. Cl. ..... 445/24; 445/50

[58] Field of Search ..... 445/24, 43, 49, 445/50

[56] References Cited

U.S. PATENT DOCUMENTS

| | | | |
|---|---|---|---|
| 4,307,507 | 12/1981 | Gray et al. . | |
| 4,940,916 | 7/1990 | Borel et al. . | |
| 4,943,343 | 7/1990 | Bardai et al. | 445/24 X |
| 4,983,878 | 1/1991 | Lee et al. | 445/24 X |
| 5,038,070 | 8/1991 | Bardai et al. | 445/24 X |
| 5,057,047 | 10/1991 | Green et al. | 445/24 |
| 5,181,874 | 1/1993 | Sokolich et al. | 445/50 X |
| 5,203,731 | 4/1993 | Zimmerman | 445/24 |
| 5,411,426 | 5/1995 | Boysel | 445/50 X |
| 5,499,938 | 3/1996 | Nakamoto et al. | 445/50 |

OTHER PUBLICATIONS

C. A. Spindt, "Physical Properties of Thin-film Emission Cathodes With Molybdenum Cones," Journal of Applied Physics, 1976, pp. 5248–5263.

Junji Itoh, "Vacuum Microelectronics," Applied Physics, pp. 164–169.

M. Sokolich et al "Field Emmission From Submicron Emitter Arrays" 1990, pp. 159–162.

C. A. Spindt, "Field-Emitter Arrays for Vacuum Microelectronics" 1991, pp. 2355–2363.

Junji Itoh, "Vacuum Microelectronics" 1990, pp. 164–169.

*Primary Examiner*—Kenneth J. Ramsey

*Attorney, Agent, or Firm*—Finnegan, Henderson, Farabow, Garrett & Dunner, L.L.P.

[57] ABSTRACT

In a method for producing a micro vacuum tube, a dent and an etching stopper layer are formed on one surface of a mold substrate. An emitter layer is deposited on the etching stopper layer and the mold substrate is removed so that the emitter layer has a protuberance covered with the etching stopper layer. Further, a gate electrode layer is formed on the etching stopper layer and the gate electrode layer and the etching stopper layer covering a tip of the protuberance is removed. An interposed insulator layer is formed on the gate electrode layer and the tip of the protuberance and an anode electrode layer is formed on the interposed insulator layer. The interposed insulator layer between the tip of the protuberance and the anode electrode layer is removed so that a space is formed between the tip and the anode electrode layer.

10 Claims, 9 Drawing Sheets

METHOD OF PRODUCING MICRO VACUUM TUBE HAVING COLD EMITTER

BACKGROUND OF THE INVENTION

1. Field of the Invention

The invention relates to vacuum microelectronic devices. More particularly, the invention relates to micro vacuum tubes having cold emitters and anode electrodes, and methods of producing such micro vacuum tubes.

2. Description of the Related Art

It has been proposed to produce a micro vacuum tube having a field emission type cathode, i.e., a cold emitter. For example, Japanese Applied Physics, vol. 59, p. 146 (1990) discloses a micro vacuum tube. According to this article, a Si substrate providing a resist layer, which has, for example, a circular-shape or square-shape, is etched by anisotropic etching so that a portion of the Si substrate under the resist is under-etched. As a result, a cold emitter having the resist on the top thereof is obtained, where the cold emitter has, for example, a cone-shape.

After that, an insulator layer, a gate layer, an insulator layer, and an anode layer are deposited on the Si substrate, respectively. Then, the insulator layers, the gate layer, and the anode layer are removed with the resist by etching so that the cone-shaped emitter is exposed. Thus, the cold emitter is placed in a hole which is formed through the insulator layers, the gate layer, and the anode layer. According to this method, the anode layer is not right above the tip of the emitter, and the emitter must be composed of a material of the substrate, i.e., Si, which does not have a sufficient low work function. Therefore, this micro vacuum tube does not efficiently emit electrons.

Further, it is difficult to form uniform cold emitters having the same shape and height using this method. Therefore, each cold emitter may have a different distance from an anode disposed above the cold emitter. Also, each cold emitter may have a different distance from a respective gate electrode. This causes each emitter to have different electrical properties, e.g., a threshold voltage of emission, or resistance. As a result, when plural cold emitters are used in parallel connection, current may be concentrated in, for example, the cold emitter having the lowest electric resistance, eventually causing damage to the cold emitter.

It is also difficult to make the cold emitter have a sharp tip using this method, since under-etching is difficult to control. A blunt tip on a cold emitter causes poor field emission efficiency.

C. A. Spindt et al., J. Appl. Phys., vol. 47, 5248 (1976) discloses another method, known as "rotation vacuum deposition", for producing a cold emitter. Under this method, a $SiO_2$ layer is disposed on the Si substrate and provides a pinhole where a surface of Si substrate is exposed. A gate layer also disposed on the $SiO_2$ layer contains a pinhole. A Mo layer is deposited on the Si substrate, which is rotated during deposition. As a result, a cone-shaped cold emitter is formed directly on the Si substrate at the pinhole.

It is also difficult to form uniform cold emitters having the same shape and height using this method. Further, it is difficult to obtain a cold emitter having a sharp tip using this method.

Another reference, U.S. Pat. No. 4,940,916, discloses a micro vacuum tube and its application for display means. The micro vacuum tube provides cold emitters produced by the method of rotation vacuum deposition. Plural cold emitters are formed on a continuous resistive layer. The resistive layer is formed on an electrically conductive layer connected to a power source and formed on a substrate. Since the resistive layer is inserted between each cold emitter and electrically conductive layer, the resistive layer averages currents flowing in each cold emitter.

However, the problems of forming plural cold emitters with the same shape, the same height, the same distance from the gate electrode, and a sharp tip still remain.

Another reference, U.S. Pat. No. 4,307,507, discloses another method for producing a cold emitter. This method uses a Si substrate as a mold. The Si substrate is etched by anisotropic etching so as to have pyramid-shaped pits. A thick film of polysilicon is filled in the pits and the surface of Si substrate. After that, the Si substrate is removed by etching. As a result, a polysilicon substrate providing pyramid-shaped cold emitters is obtained. An insulator layer and a gate electrode are then provided on the pyramid-shaped cold emitters.

In accordance with the method, cold emitters must be made of materials having small inner stress, such as polysilicon, because it is difficult to form thick films with a material having large inner stress. As a result, it is difficult to obtain a cold emitter of a material having a low working function, i.e., a material easy to emit an electron.

Furthermore, a large force might be applied between a cold emitter and a gate electrode, requiring the cold emitter to have sufficient strength so as to maintain the distance between the cold emitter and the gate electrode to avoid concentration current. However, it is difficult to obtain a cold emitter made of a material having such a high strength.

SUMMARY OF THE INVENTION

Accordingly, the present invention is directed to a micro vacuum tube that substantially obviate one or more of the problems due to limitations and disadvantages of the related art.

One object of the present invention is to provide a micro vacuum tube including a cold emitter, and an anode, which is right above the tip of the cold emitter monolithically.

Another object of the present invention is to provide a micro vacuum tube including an anode and a cold emitter which has a sharp tip.

Still another object of the present invention is to provide a micro vacuum tube including an anode, and plural cold emitters having substantially the same shape.

Yet another object of the present invention is to provide a micro vacuum tube including an anode, and a cold emitter made of a material having a large inner stress.

A further object of the present invention is to provide a micro vacuum tube including an anode, and a cold emitter having a sufficient strength.

To achieve these and other advantages and in accordance with the purpose of the invention, as embodied and broadly described herein, one aspect of the invention includes a method for producing a micro vacuum tube including an emitter layer having a protuberance, comprising the steps of forming a removable layer on the tip of the protuberance; forming an anode layer on the removable layer; and removing the removable layer so that a space is formed between the anode layer and the tip of the protuberance.

In another aspect, the present invention provides a micro vacuum tube including an emitter layer having a protuberance; and an anode electrode layer having a throughhole and disposed above a tip of the protuberance so as to provide a space between the tip and the anode electrode layer.

BRIEF DESCRIPTION OF THE DRAWINGS

The accompanying drawings, which are incorporated in and constitute a part of this specification, illustrate embodiments of the invention and together with the description, serve to explain the objects, advantages, and principles of this invention.

In the drawings, FIGS. 1(*a*)–(*j*) are cross-sectional views of a micro vacuum tube at different phases of a process for producing a micro vacuum tube in accordance with a first embodiment of the present invention.

DETAILED DESCRIPTION

Figure 1:
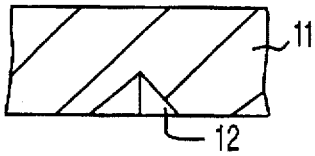
Figure 1:
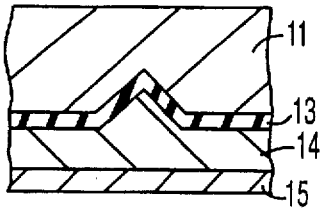
Figure 1:
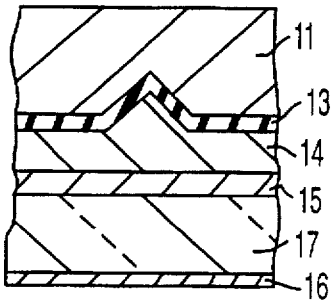
Figure 1:
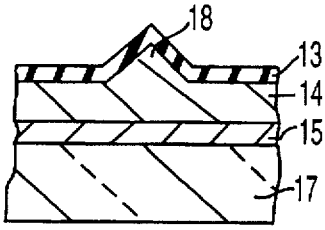
Figure 1:
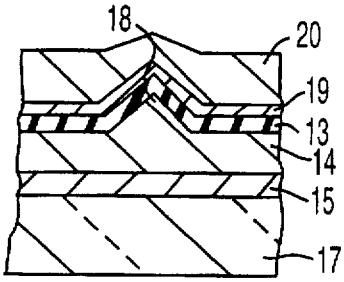
Figure 1:
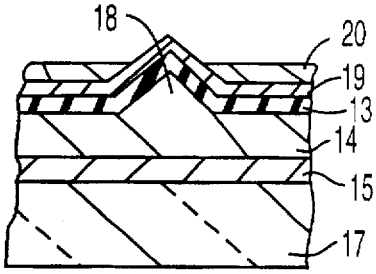
Figure 1:
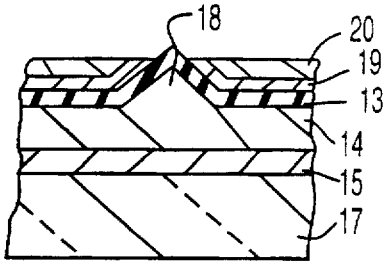
Figure 1:
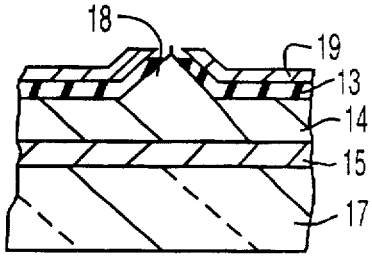
Figure 1I:
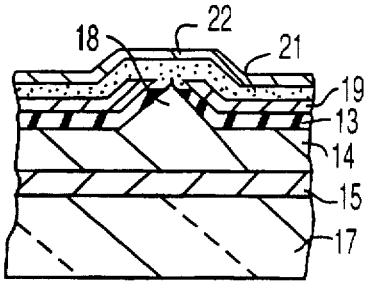
Figure 1:
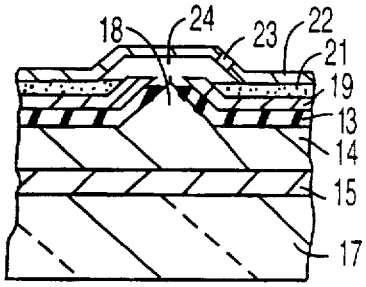

FIGS. 1(*a*)–(*i*) are cross-sectional views of a micro vacuum tube at different phases of a process for producing a micro vacuum tube in accordance with a first embodiment of the present invention.

A substrate 11 made of, for example, Si, has a dent 12, which may be produced by etching. Substrate 11 is preferably a p-type Si monocrystal having a crystal direction of (100). An oxide layer is formed on the substrate by thermal dry oxidation, where the oxide layer has a thickness of about 0.1 μm. Using a photo-etching process involving, for example, a mixture of $NH_4F$ and HF, an opening is provided in the oxide layer. Then, by anisotropic etching (e.g., using an aqueous solution containing 30 wt % of KOH), a pyramid-shaped dent 12 can be obtained corresponding to the opening. Subsequently, the remaining oxide layer is removed (FIG. 1(*a*)) by etching, for example, with an aqueous solution containing 30 wt % of KOH. When the opening is a 0.8 μm square, a depth of dent 12 would be about 0.56 μm.

Substrate 11 preferably provides plural dents 12, although FIG. 1(*a*) shows only one dent 12. Anisotropic etching is effective to obtain a sharp tip on dent 12, and, further, to obtain plural dents 12 having the same shape. However, other methods besides anisotropic etching can be used to produce dent 12 in accordance with the invention.

An insulator layer 13, which may comprise a 200 nm layer of $SiO_2$ is formed on substrate 11, for example, by thermal dry oxidation. Insulator layer 13 will be used as an etching stopper. Therefore, the thickness is preferably about 50 nm or more.

Insulator layer 13 may be formed by other methods such as chemical vapor deposition (CVD). However, thermal oxidation is more preferable than CVD or other methods. A thickness of insulator layer 14 at sides of dent 12 is thicker than that at the tip with thermal oxidation so as to make the tip sharper. Therefore, thermal oxidation is effective to obtain a sharp tip. Further, even if each depth of plural dents 12 is slightly different, thermal oxidation can relieve the difference.

An emitter layer 14 is formed on insulator layer 13, for example, by sputtering. Emitter layer 14 is preferably composed of a material which is chemically and physically stable, and has a small work function, e.g., W, Mo, Ta, or $LaB_6$. Emitter layer 14 may be comprised of plural layers.

A conductive layer 15 having a thickness of, for example, about 500 nm, is formed on emitter layer 14 (FIG. 1(*b*)). Conductive layer 15 may have a lower electric resistance than emitter layer 14, such as ITO, Cu, Ag, Au, or Al. When emitter layer 14 has sufficiently low electric resistance, conductive layer 15 is not necessary.

A structural substrate 17 providing a back coating conductive layer 16 on one side (e.g., about 400 nm of Al), is joined with conductive layer 15 at the other side (FIG. 1(*c*)). For example, "Pyrex" glass having a thickness of about 1 mm can be used. Structural substrate 17 may be composed of glasses or ceramics, which are insulators.

When an electrostatic bonding method is used to join structural substrate 17 with conductive layer 15, structural substrate 17 is required to provide back coating conductive layer 16 so as to apply a voltage between a back coating conductive layer 16 and conductive layer 15. After bonding, back coating conductive layer 16 may be removed by, for example, a mixture solution of $HNO_3$, $CH_3COOH$, and HF. However, back coating layer 16 could be used as a shield against electromagnetic noises.

Substrate 11 is removed so that insulator layer 13 is exposed (FIG. 1(*d*)) by etching for example, with a mixed aqueous solution of ethylen diamine, pyrocatechol, pyrazine, and water (=75 cc:12 g:3 mg:10 cc). Insulator layer 13 fills the role of an etching stopper so as to defend a tip of a cold emitter, i.e., the bottom of dent 12 against etching. As a result, a protuberance 18, i.e., a cold emitter, is obtained, and the protuberance is coated with insulator layer 13. Since substrate 11 is used as a mold, substrate 11 can be referred to us a mold substrate.

A gate electrode layer 19, which may comprise a 300 nm layer of W, is deposited on insulator layer 13, for example, by sputtering. A photoresist layer 20 is deposited on gate electrode layer 19, which is sufficiently thick for the top of protuberance 18 to be buried, for example, about 300 nm (FIG. 1(*e*)).

Then, photoresist layer 20 is etched so that gate electrode layer 19 at the top of protuberance 18, which may be a 400 nm square, is exposed (FIG. 1(*f*)) by, for example, dry etching with oxygen plasma. After that, gate electrode layer 19 at the top of protuberance 18 is removed by etching, such as, reactive ion etching or wet-etching, so that a tip of protuberance 18 of insulator layer 13 is exposed (FIG. 1(*g*)).

Insulator layer 13 at the tip of protuberance 18 is removed by etching, for example, using a mixture solution of $NH_4F$ and HF, so that a tip of protuberance 18 of emitter layer 14 is exposed (FIG. 1(*h*)), then photoresist layer 20 is removed. As a result, the tip of emitter layer 14 is surrounded by gate electrode layer 19.

A removable layer 21, such as a PSG (P-doped silicate glass), is deposited on gate electrode layer 19 and protuberance 18, for example, by CVD, EB vapor deposition, or sputtering. An anode electrode layer 22, such as W, Mo, or Ta, is deposited on removable layer 21, for example, by sputtering (FIG. 1(*i*)).

Anode electrode layer 22 provides a throughhole 23 above protuberance 18. Removal layer 21 is partially removed through throughhole 23 so as to make a space 24 between anode electrode layer 22 and the tip of protuberance 18 (FIG. 1(*j*)), for example, by etching with a mixture solution of $NH_4F$ and HF.

Remaining part of removable layer 21 becomes an interposed insulator layer between anode electrode layer 22 and gate electrode layer 19.

Figure 2:
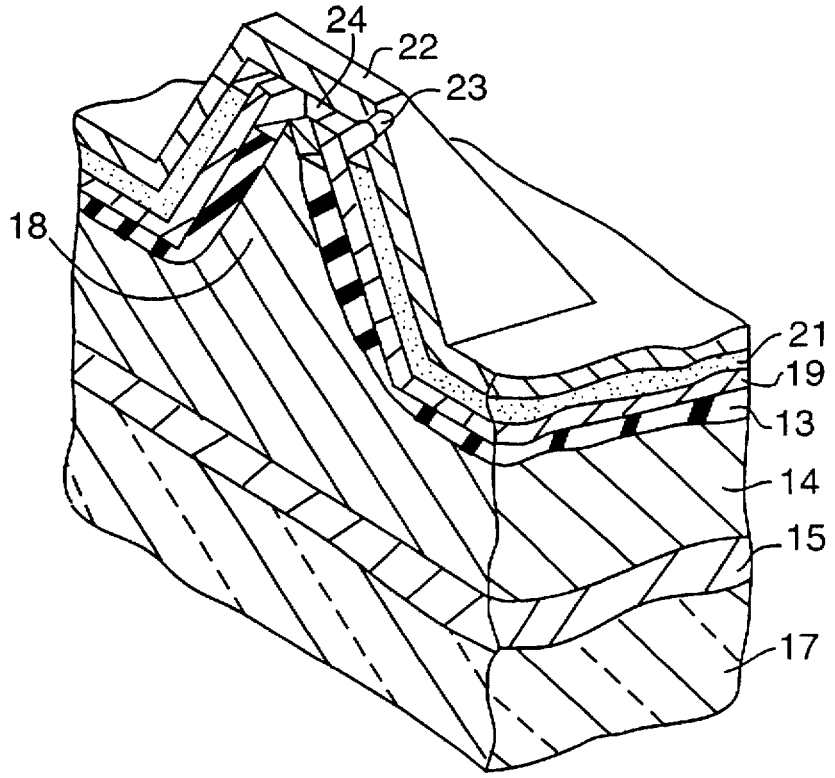
FIG. 2 is a cross-sectional perspective view of a micro vacuum tube in accordance with the first embodiment of the invention.

FIG. 2 shows a partially cutaway perspective view of a micro vacuum tube of FIG. 1(*j*). The micro vacuum tube is used in a vacuum. According to this embodiment of FIGS. 1(*a*)–(*j*) and FIG. 2, a micro vacuum tube can provide an anode, a gate, and an emitter monolithically. Therefore, distances between each tip of protuberance 18 and each gate electrode layer 19 can be accurately controlled, i.e., to be made uniform. Distances between each tip of protuberance 18 and each anode electrode layer 23 are also easy to be made uniform.

Further, a cold emitter having a sharp tip could be obtained, and the anode could be right above the tip of the emitter. Therefore, high efficiency to emit electrons could be obtained.

Figure 3:
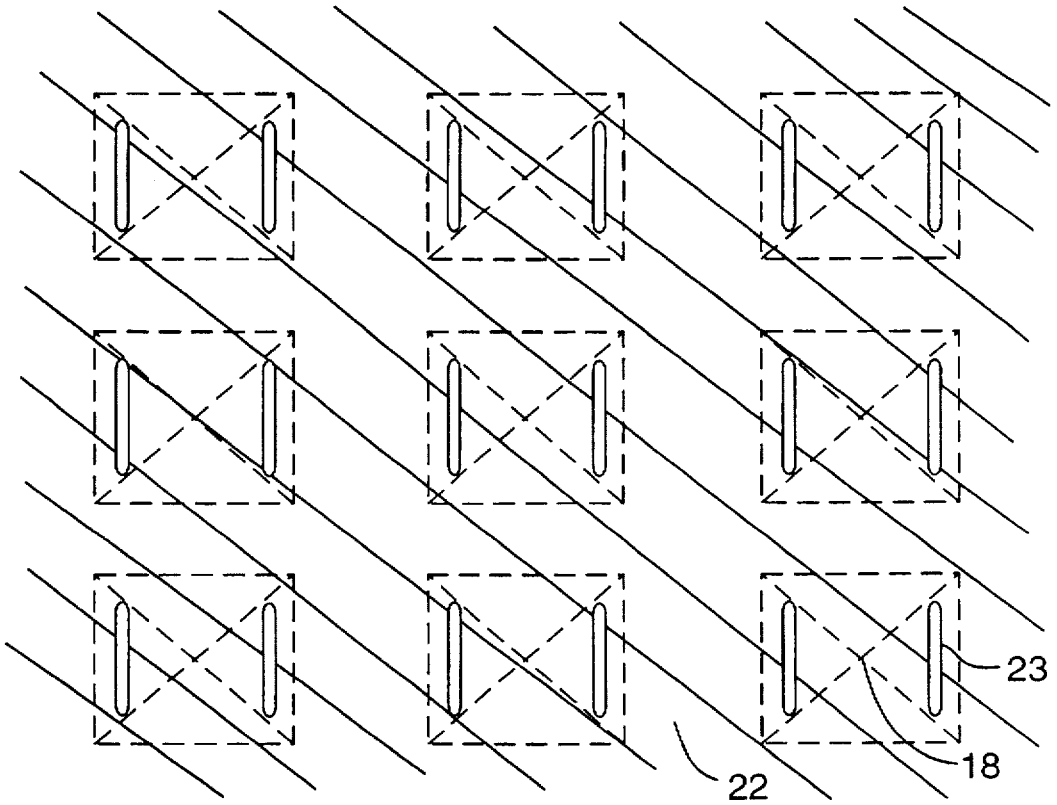
FIG. 3 is a plane view of a micro vacuum tube in accordance with a second embodiment of the present invention.

Throughhole 23 is preferably not right above the tip of protuberance 18 so as to protect the tip from etching. For example, the distribution of throughholes 23 is shown in FIG. 3, which is a plane view of a micro vacuum tube of a second embodiment of the present invention. Anode electrode layer 22 provides throughholes 23 at both sides of each tips of protuberances 18.

Further, it is not necessarily required that each protuberance 18 has its own corresponding throughhole 23. In other words, one throughhole 23 could provide an opening to plural protuberances 23.

Since the micro vacuum tube according to the first embodiment provides throughhole 23, i.e., space 24 is not closed, high vacuum around space 24 can easily be obtained by pumping during a vacuum sealed process. Moreover, if a particle or gas is generated during the device operation, a degree of vacuum would not deteriorate, because the particle or gas would be dispersed through throughhole 23. As a result, reliability would be improved more than in the case without throughhole 23.

Figure 4:
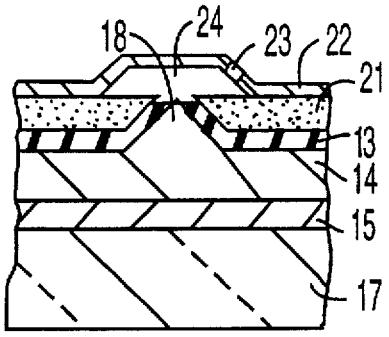
FIG. 4 is a cross-sectional view of a micro vacuum tube in accordance with a third embodiment of the present invention.

A micro vacuum tube according to the present invention can also be applied to a diode. In a diode, gate electrode 19 is not required. FIG. 4 shows a cross-sectional view of a micro vacuum tube of a third embodiment of the present invention, wherein gate electrode layer 19 is not provided. Except for gate electrode layer 19, the structure of FIG. 4 is the same as the device shown in FIG. 1(*j*).

Figure 5:
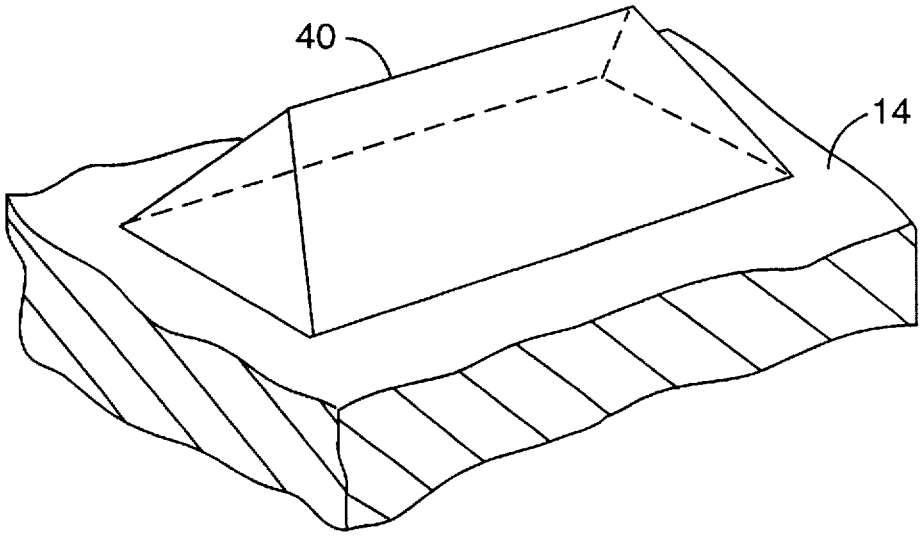
FIG. 5 is a perspective view of a cold emitter of a micro vacuum tube in accordance with a fourth embodiment of the present invention.

The cold emitter is not limited to a pyramid-shape. For example, a cold emitter of the present invention could have a roof-shape having a ridge 40 as shown in FIG. 5. The cold emitter in FIG. 5 would have a large current capacity. Such a cold emitter could be obtained by the same method of FIG. 1(*a*). For example, as discussed above, in FIG. 1(*a*), a pyramid-shaped dent 12 is obtained by using a resist providing a square opening for anisotropic etching. If the opening is a rectangle, dent 12 would have the same shape as the protuberance in FIG. 5.

In the present invention, removable layer 21 may be made of a photoresist. Further, removable layer 21 may be disposed only on protuberance 20. In such a case, another insulator layer would be disposed between gate electrode layer 13 and anode electrode layer 23.

Figure 6:
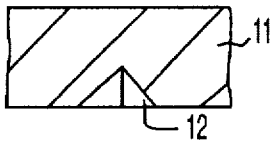
FIGS. 6(*a*)–(*j*) are cross-sectional views of a micro vacuum tube at different phases of a process for producing a micro vacuum tube in accordance with a fifth embodiment of the present invention.
Figure 6:
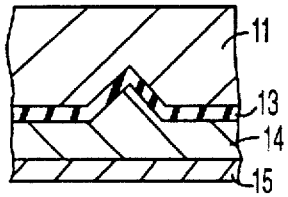
Figure 6:
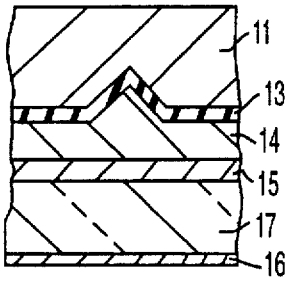
Figure 6:
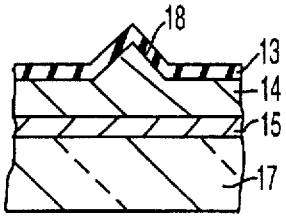
Figure 6:
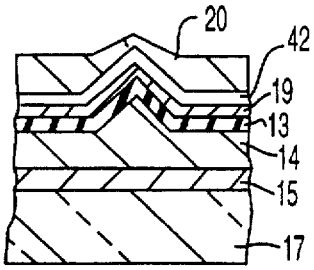
Figure 6:
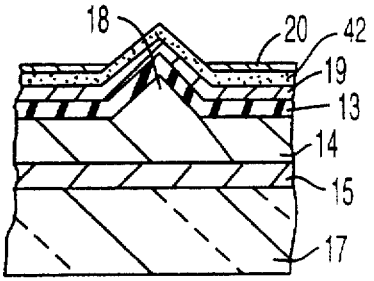
Figure 6:
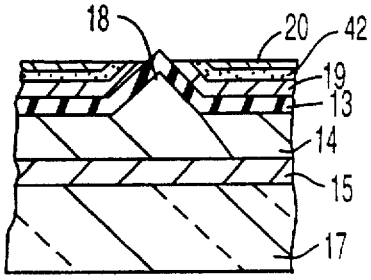
Figure 6:
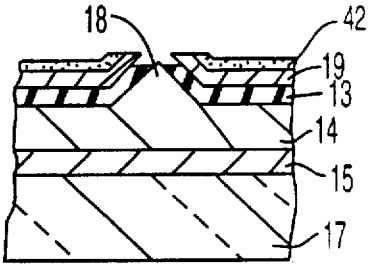
Figure 6:
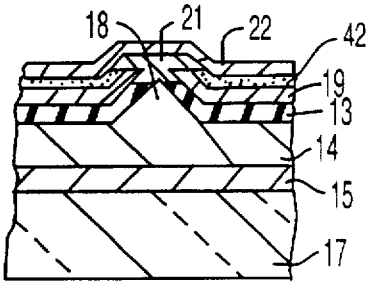
Figure 6:
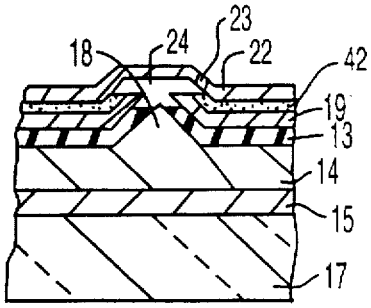

FIGS. 6(*a*)–(*h*) are cross-sectional views showing a process for producing a micro vacuum tube of a fifth embodiment of the present invention. FIGS. 6(*a*)–(*d*) are the same as FIGS. 1(*a*)–(*d*), and the same method is used.

Gate electrode layer 19, such as a 300 nm layer of W, is deposited on insulator layer 13. An interposed insulator layer 42, which may comprise 100 nm of $SiO_2$, is deposited on gate electrode 19, for example, by CVD. Photoresist layer 20 is deposited on interposed insulator layer 42, which is sufficiently thick for the top of protuberance 18 to be buried, for example, about 300 nm (FIG. 6(*e*)).

Then, photoresist layer 20 is etched so that interposed insulator layer 42 at the top of protuberance 18 of about 400 nm square is exposed (FIG. 6(*f*)) by, for example, dry etching. After that, gate electrode layer 19 and interposed insulator layer 42 at the top of protuberance 18 are removed so that the tip of protuberance 18 of insulator layer 13 is exposed (FIG. 6(*g*)).

After removing photoresist layer 20, insulator layer 13 at the tip of protuberance 18 is removed so that a tip of protuberance 18 of emitter layer 14 is exposed (FIG. 6(*h*)). The tip of the exposed emitter layer 14 is surrounded by gate electrode layer 19.

Removable layer 21 is deposited on the exposed emitter layer 14. Anode electrode layer 22 is deposited on removable layer 21 and interposed insulator layer 42 (FIG. 6(*i*)).

Anode electrode layer 22 provides a throughhole 23 above protuberance 18. Removal layer 21 is removed through throughhole 23 so as to make space 24 between anode electrode layer 22 and the tip of protuberance 18 (FIG. 6(*j*)).

According to this method, since removable layer 21 and interposed layer 42 are provided, the size of space 24 is easy to be controlled. Moreover, the removable layer can be made of silicon nitride or silicon oxide.

In the above-mentioned examples, insulator layer 13 is used as an etching stopper. However, a doped layer formed on the surface of dent 12 may be used as an etching stopper. For example, before forming insulator layer 13 in FIG. 1(*b*), a doped layer 44 may be formed on the surface of dent 12, for example, by diffusion.

Figure 7:
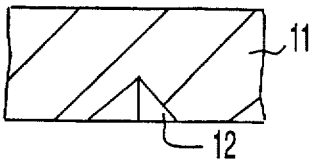
FIGS. 7(*a*)–(*j*) are cross-sectional views of a micro vacuum tube at different phases of a process for producing a micro vacuum tube in accordance with a sixth embodiment of the present invention.
Figure 7:
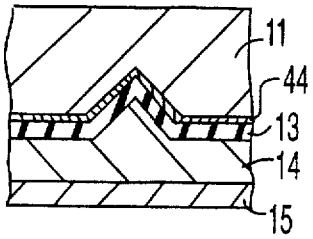
Figure 7:
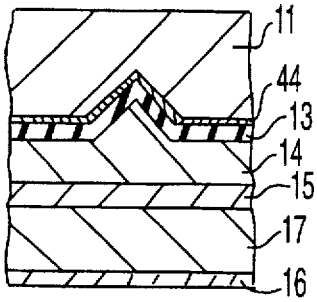
Figure 7:
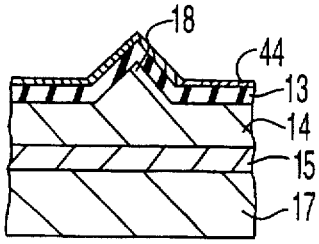
Figure 7:
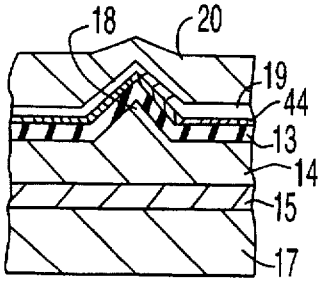
Figure 7:
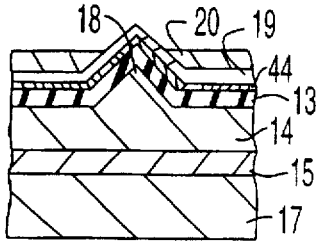
Figure 7:
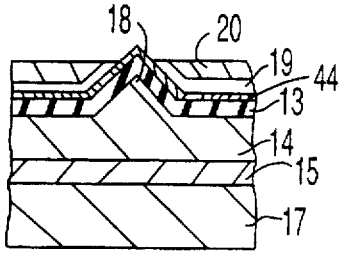
Figure 7:
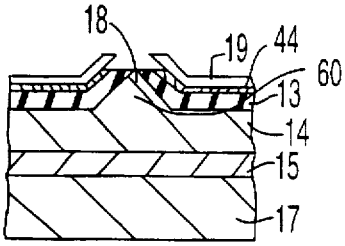
Figure 7:
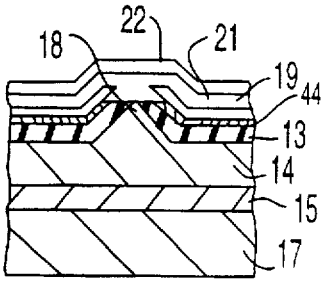
Figure 7:
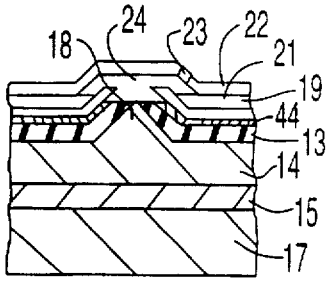

FIGS. 7(*a*)–(*j*) are cross-sectional views showing a process for producing a micro vacuum tube of a sixth embodiment of the present invention. FIGS. 7(*a*)–(*j*) are the same as FIGS. 1(*a*)–(*j*), and the same method is used, except that doped layer 44 made of, for example, a 100 nm boron doped layer, is provided.

At a phase of FIG. 7(*d*), doped layer 44 and insulator layer operate as etching stoppers. Therefore, the tip of dent 12 could be protected against etching.

At a phase of FIG. 7(*h*), doped layer 44 and insulator layer are removed so that the tip of protuberance 18 is exposed.

When doped layer 44 has a sufficiently low electric resistance, such as about $10^{-4}$ Ω.cm or less, or has a sufficiently high doping concentration, such as at least $10^{20}$ $cm^{-3}$ or $10^{21}$ $cm^{-3}$, doped layer 44 acts as a conductive layer and a gate electrode. In such a case, gate electrode layer 19 may be omitted.

Figure 8:
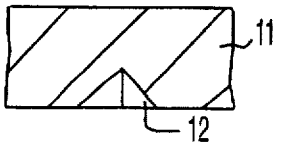
FIGS. 8(*a*)–(*j*) are cross-sectional views of a micro vacuum tube at different phases of a process for producing a micro vacuum tube in accordance with a seventh embodiment of the present invention.
Figure 8:
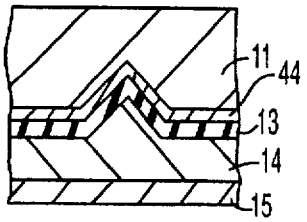
Figure 8:
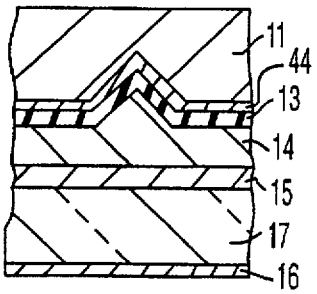
Figure 8:
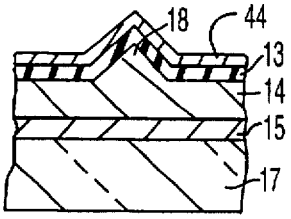
Figure 8:
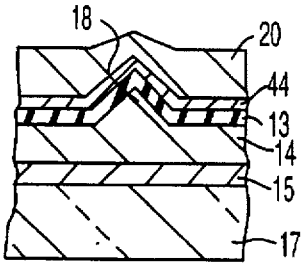
Figure 8:
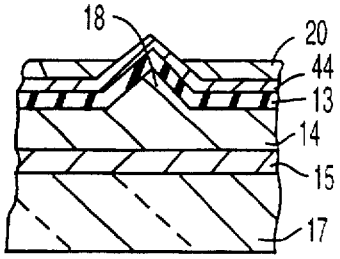
Figure 8:
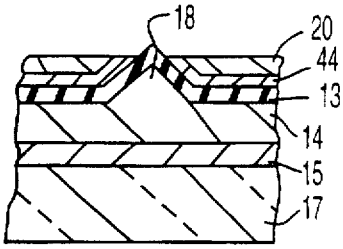
Figure 8:
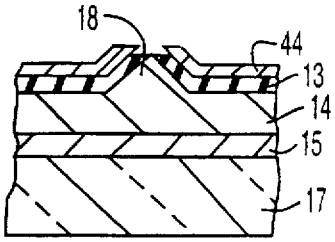
Figure 8:
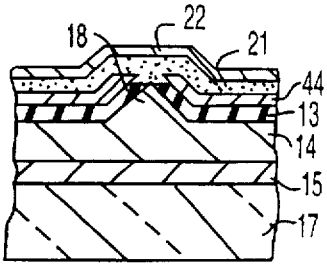
Figure 8:
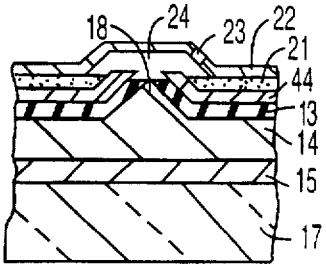

FIGS. 8(*a*)–(*j*) show cross-sectional views of a micro vacuum tube of a seventh embodiment of the present invention. This micro vacuum tube of FIG. 8 provides the same structure as FIG. 7 except for doped layer 44. Doped layer 44 at a phase of FIG. 8(*b*) is used as gate electrode layer 19 in FIGS. 1(*e*)–(*j*).

Figure 9:
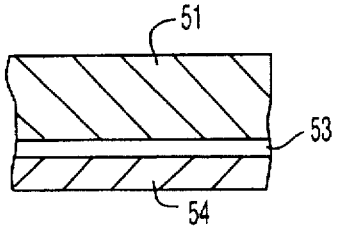
FIGS. 9(*a*)–(*k*) are cross-sectional views of a micro vacuum tube at different phases of a process for producing a micro vacuum tube in accordance with an eighth embodiment of the present invention.
Figure 9:
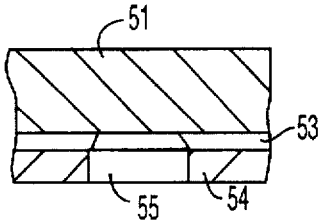
Figure 9:
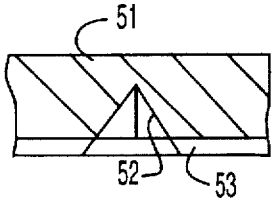
Figure 9:
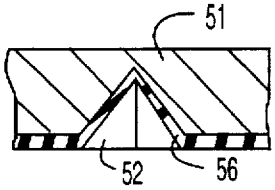
Figure 9:
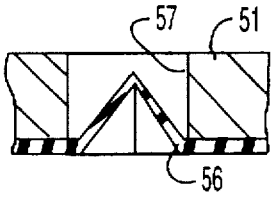
Figure 9:
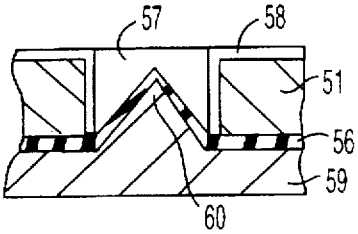
Figure 9:
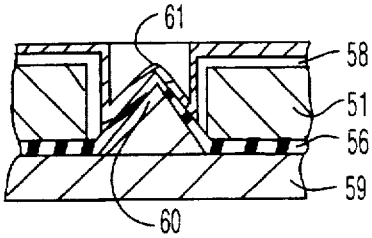
Figure 9:
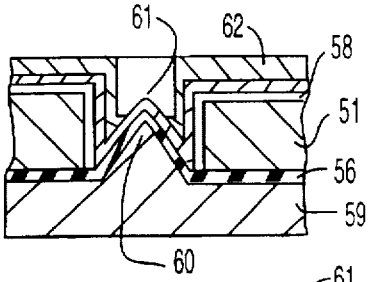
Figure 9:
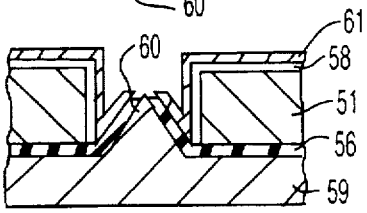
Figure 9:
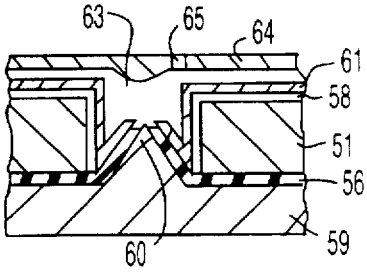
Figure 9:
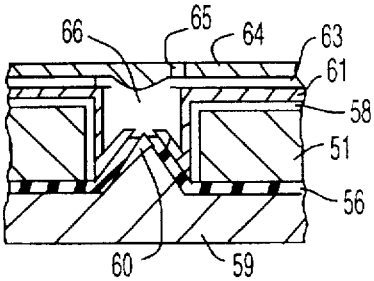

FIGS. 9(*a*)–(*k*) are cross-sectional views showing a process for producing a micro vacuum tube of an eighth embodiment of the present invention.

A Si substrate 51 provides a dent 32 on a side, which can be obtained using the same method described in connection with the first embodiment. An oxide layer 53, such as a 100 nm layer of $SiO_2$, is formed on substrate 51 by a thermal dry oxidation and a photo resist 54 is formed on oxide layer 53 (FIG. 9(*a*)) by spin coating.

By photo-etching process with a mixture of $NH_4F$ and HF, an opening 55, such as 1 μm square, is provided in oxide layer 53 (FIG. 9(*b*)). After that, by anisotropic etching with an aqueous solution containing 30 wt % of KOH, dent 52 is obtained (FIG. 9(*c*)). When opening 55 is 1 μm square, the depth of dent 52 would be about 710 nm. Then oxide layer 53 is removed. Substrate 51 preferably provides plural dents 52, although FIGS. 9(*a*)–(*k*) show only one dent 52.

Substrate 51 is oxidized so as to form an insulator layer 56, such as 300 nm of $SiO_2$, on the surface of dent 52 (FIG. 9(*d*)). After that, substrate 51 is etched from the other side to make a hole 57 so that insulator layer 56 is exposed (FIG. 9(*e*)).

Substrate 51 is oxidized so as to form an insulator layer 58, for example, 200 nm, on the surface providing hole 57. An emitter layer 59, such as 1000 nm of W, is formed on dent 52 (FIG. 9(*e*)). As a result, a protuberance 60 of emitter layer 59, i.e., a cold emitter, is obtained.

A gate electrode layer 61, such as a 400 nm layer of W, is deposited on insulator layer 58 from the opposite side of dent 52 (FIG. 9(*g*)). A photoresist layer 62 is coated on gate electrode layer 61 and, then, photoresist layer 62 is etched so that the top of protuberance 60 of, for example, 700 nm square, covered with insulator layer 56 and gate electrode layer 61, is exposed (FIG. 9(*h*)).

After that, gate electrode layer 61 at the top of protuberance 60 is removed by etching (FIG. 9(*i*)). As a result, a tip of protuberance 60 and emitter layer 59 are surrounded by gate electrode layer 61.

A removable layer 63 is deposited on the exposed emitter layer 59 and gate electrode layer 61. An anode electrode layer 64 is deposited on removable layer 59 (FIG. 9(*j*)). Anode electrode layer 64 provides a throughhole 65 above protuberance 60. Removal layer 63 is removed through throughhole 65 so as to make a space 66 between anode electrode layer 64 and the tip of protuberance 60 (FIG. 9(*k*)).

A doped layer could be provided as etching stopper, like as shown in FIG. 7(*h*). Also, a gate electrode layer 43 could be replaced by the doped layer.

In this example, since substrate 51 remains after etching, it is not necessarily required to provide structural substrate 17 of FIG. 1(*j*). However, a structural substrate could be provided to strengthen a micro vacuum tube.

Figure 10:
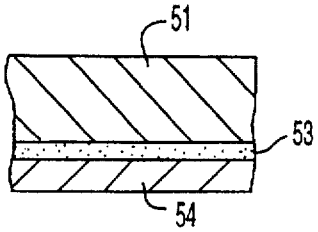
FIGS. 10(*a*)–(*k*) are cross-sectional views of a micro vacuum tube at different phases of a process for producing a micro vacuum tube in accordance with a ninth embodiment of the present invention.
Figure 10:
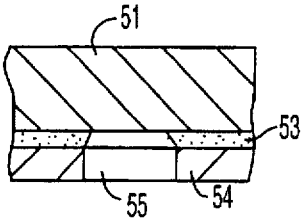
Figure 10:
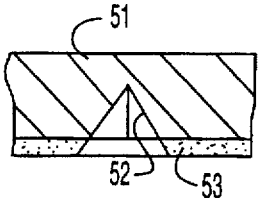
Figure 10:
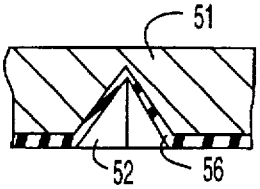
Figure 10:
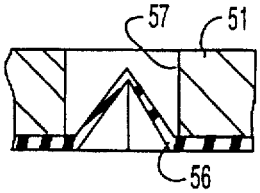
Figure 10:
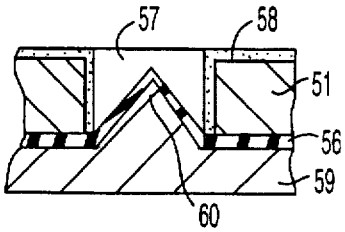
Figure 10:
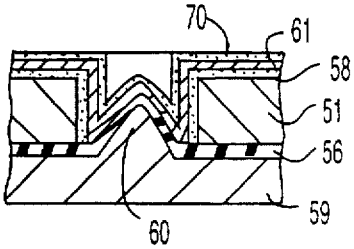
Figure 10:
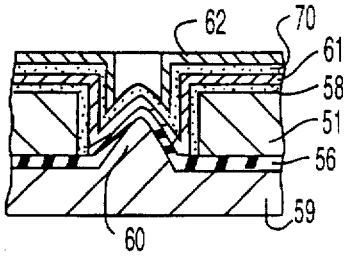
Figure 10:
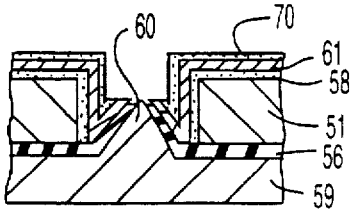
Figure 10:
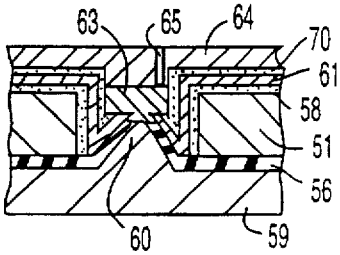
Figure 10:
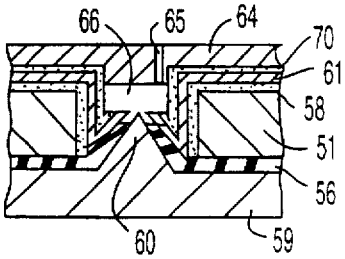

FIGS. 10(*a*)–(*k*) are cross-sectional views showing a process for producing a micro vacuum tube of a ninth embodiment of the present invention, which is a variation from the eighth embodiment, like as the second embodiment is a variation from the first embodiment.

Except for providing an interposed insulator layer 70, FIGS. 10(*a*)–(*k*) are the same as FIGS. 9(*a*)–(*k*), and the same method could be used.

In the above-mentioned examples, an emitter layer is composed of one layer. However, the emitter layer could be composed of two or more layers.

Figure 11:
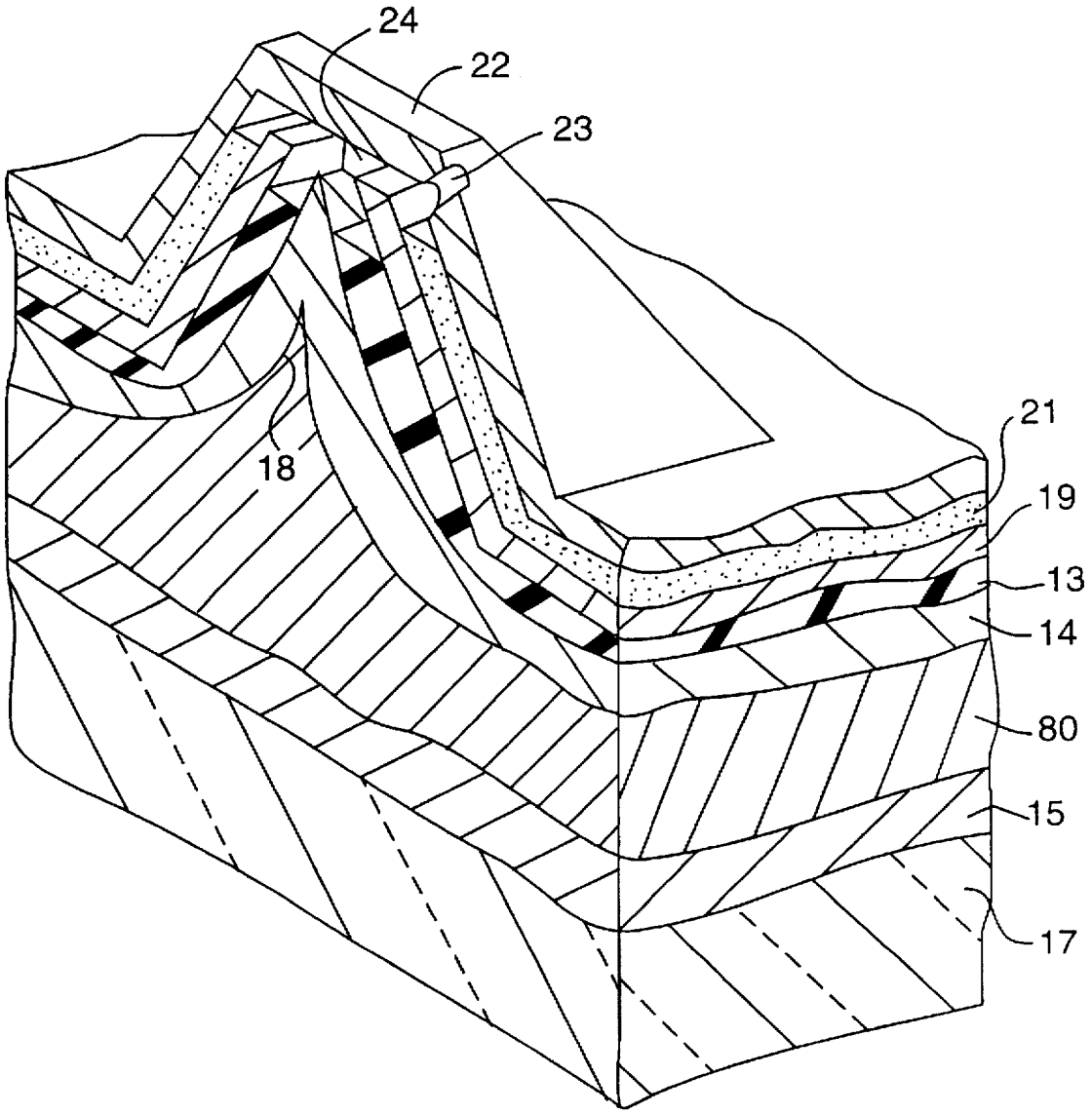
FIG. 11 is a conceptual view of a micro vacuum tube of a tenth embodiment of the present invention.

FIG. 11 shows a partially cutaway perspective view of a micro vacuum tube of a tenth embodiment of the present invention. In FIG. 11, protuberance 18 is composed of emitter layer 14, and core layer 80 coated with emitter layer 14. Besides these layers, the structure is the same as shown in FIG. 2.

It is possible to change materials between emitter layer 14 and core layer 80. Most of materials easy to emit electrons have large inner stress. Therefore, a thick film of the materials is difficult to obtain. However, according to the present invention, even if materials have large inner stress, since an emitter material could be disposed only at a surface of a protuberance, a cold emitter made of the materials having large inner stress, could be produced. As a result, a micro vacuum tube could have high efficiency to emit electrons.

Further, when an electric resistance of core layer 90 is larger than that of emitter layer 14, core layer 80 may fill a electric resistance to average currents flowing in each cold emitter. When a current is concentrated in one cold emitter, a bias voltage of the one cold emitter would be reduced due to the electric resistance of the core layer. In order to increase the current averaging effect, it is preferable that the emitter layer is divided in each cold emitter or in small cold emitters groups, for example, by photolithography.

Furthermore, when a core layer is made of hard materials, the distance between a tip of a cold emitter and a gate electrode could be maintained, even if a large force is applied by an electric field.

Also, according to the method of the present invention, emitter materials could be selected widely. Further, if plural cold emitters are provided, it is possible to produce the plural cold emitters having the same shape, since anisotropic etching could be used.

A micro vacuum tube of the present invention can be used as a current control device with high speed switching or with large current flow, since electrons flow in a vacuum. Large current control devices preferably provide plural cold emitters.

Further, a micro vacuum tube of the present invention can be used as a display. In such a case, for example, a phosphor layer is provided on an anode electrode to emit light.

Plural cold emitters may be controlled as a whole, i.e., all emitters turn on and off together. Also, plural cold emitters may be individually controlled by controlling individual emitters or groups of emitters.

Furthermore, when another electrode layer, such as a grid electrode layer, is provided between the anode electrode layer and the tip of the protuberance of the emitter layer, a tetrode could be obtained. Moreover, a pentode or other vacuum tube having more electrodes could be obtained.

It will be apparent to those skilled in the art that various modifications and variations can be made in the micro vacuum tube of the present invention without departing from the spirit or scope of the invention. Thus, it is intended that the present invention cover the modifications and variations of this invention provided they come within the scope of the appended claims and their equivalents.

What is claimed is:

1. A method for producing a micro vacuum tube including an emitter layer having a protuberance, comprising the steps of:

forming a removable layer on a tip of the protuberance;

forming an anode electrode layer on the removable layer and an interposed insulator layer between the anode electrode layer and the emitter layer, with the interposed insulator layer and the removable layer comprising one layer; and removing the removable layer so that a space is formed between the anode electrode layer and the tip of the protuberance.

2. The method according to claim 1, wherein the micro vacuum tube further comprises a gate electrode layer surrounding the tip of the protuberance.

3. The method according to claim 1, wherein the anode electrode layer provides a throughhole so that the removable layer is removed through the throughhole during the step of removing the removable layer.

4. The method according to claim 1, wherein the emitter layer comprises a plurality of layers.

5. A method for producing a micro vacuum tube including an emitter layer having a protuberance, comprising the steps of:

forming the emitter layer having the protuberance by forming a dent on one surface of a mold substrate comprising a semiconductor, forming an etching stopper layer comprising an oxidation layer of the mold substrate and a doped layer of the semiconductor, depositing the emitter layer on the etching stopper layer, removing the mold substrate so that the etching stopper layer at the dent is exposed and the protuberance of the emitter layer is obtained, removing the etching stopper layer at a tip of the protuberance so that the emitter layer is exposed, forming a removable layer on the tip of the protuberance, forming an anode electrode layer on the removable layer, and removing the removable layer so that a space is formed between the anode electrode layer and the tip of the protuberance.

6. The method according to claim 5, wherein a pair of the mold substrate remains after the step of removing the mold substrate, so that the remaining part of the mold substrate surrounds the protuberance of the emitter layer.

7. The method according to claim 5, wherein the micro vacuum tube further comprises a gate electrode layer surrounding the tip of the protuberance of the emitter layer.

8. A method for producing a micro vacuum tube comprising the steps of:

forming a dent on a surface of a mold substrate;

forming an etching stopper layer of insulator on the surface of the mold substrate;

depositing the emitter layer on the etching stopper layer;

removing the mold substrate so that the emitter layer has a protuberance covered with the etching stopper layer;

forming a gate electrode layer on the etching stopper layer;

removing the gate electrode layer and the etching stopper layer which cover a tip of the protuberance;

forming an interposed insulator layer on the gate electrode layer and the tip of the protuberance;

forming an anode electrode layer on the interposed insulator layer; and removing a part of the interposed insulator layer which is between the tip of the protuberance and the anode electrode layer so that a space is formed between the tip and the anode electrode layer.

9. A method for producing a micro vacuum tube including an emitter layer having a protuberance, comprising the steps of:

forming the emitter layer having the protuberance by forming a dent on one surface of a mold substrate comprising a semiconductor, forming an etching stopper layer comprising an oxidation layer of the mold substrate and a doped layer of the semiconductor, depositing the emitter layer on the etching stopper layer, removing the mold substrate so that the etching stopper layer at the dent is exposed and the protuberance of the emitter layer is obtained, removing the etching stopper layer at a tip of the protuberance so that the emitter layer is exposed with a part of the doped layer remaining after the removal of the etching stopper layer so that a remaining portion of the doped layer surrounds the tip of the protuberance of the emitter layer and serves as a gate electrode, forming a removable layer on the tip of the protuberance, forming an anode electrode layer on the removable layer, and removing the removable layer so that a space is formed between the anode electrode layer and the tip of the protuberance.

10. A method for producing a micro vacuum tube including an emitter layer having a protuberance with a structural substrate disposed on the emitter layer, comprising the steps of:

forming the emitter layer having the protuberance by forming a dent on one surface of a mold substrate comprising a semiconductor, forming an etching stopper layer comprising an oxidation layer of the mold substrate and a doped layer of the semiconductor, depositing the emitter layer on the etching stopper layer, removing the mold substrate so that the etching stopper layer at the dent is exposed and the protuberance of the emitter layer is obtained, removing the etching stopper layer at a tip of the protuberance so that the emitter layer is exposed, forming a removable layer on the tip of the protuberance, forming an anode electrode layer on the removable layer, and removing the removable layer so that a space is formed between the anode electrode layer and the tip of the protuberance.

* * * * *